United States Patent [19]

Pilachowski et al.

[11] 4,419,048

[45] Dec. 6, 1983

[54] TRASH PUMP WITH RESILIENT LINER

[75] Inventors: Martin T. Pilachowski, Kewaskum; Alan J. Ritz, Brookfield, both of Wis.

[73] Assignee: Wacker Corporation, Milwaukee, Wis.

[21] Appl. No.: 380,535

[22] Filed: May 21, 1981

[51] Int. Cl.[3] ..... F04D 29/40; F04D 7/06

[52] U.S. Cl. ..... 415/196; 415/197; 415/206

[58] Field of Search ..... 415/196, 197, 206, 219 C, 415/DIG. 3, 213 R, 121 B, 121 G

[56] References Cited

U.S. PATENT DOCUMENTS

| | | | |
|---|---|---|---|
| 640,345 | 1/1900 | Wilberforce . | |
| 1,952,179 | 3/1934 | Milkowski et al. | 415/196 |
| 2,433,589 | 12/1947 | Adams | 415/196 X |
| 3,079,866 | 3/1963 | Walker | 415/196 X |
| 3,183,841 | 5/1965 | Gaynor . | |
| 3,247,801 | 4/1966 | Conery | 415/196 X |
| 3,272,137 | 9/1966 | Maitlen et al. | 415/196 X |
| 3,322,071 | 5/1967 | Teter | 415/196 |
| 3,324,800 | 6/1967 | Schroeder | 415/196 X |
| 3,381,617 | 5/1968 | Wright | 415/197 |
| 3,576,380 | 4/1971 | Sargeant | 415/197 X |
| 4,052,133 | 10/1977 | Yeater | 415/197 X |
| 4,129,402 | 12/1978 | Eberhardt | 415/196 X |
| 4,202,654 | 5/1980 | Marlow . | |

*Primary Examiner*—Philip R. Coe
*Assistant Examiner*—Shewen Bian
*Attorney, Agent, or Firm*—James E. Nilles

[57] ABSTRACT

A trash pump having a mixed flow impeller has a housing with a rear wall through which the impeller shaft extends. A large front opening in the housing is sealingly closed by a readily detachable cover member wherein there is a port through which water enters the housing. Attached to the rear of the cover member is a volute that is received in the housing through said front opening therein and whereby water centrifuged from the impeller is guided in spiral flow to a side outlet in the housing. The rear portion of the volute, wherein there is an opening through which the impeller can pass, is adjacent to the rear wall of the housing all around the shaft. A front wall of the volute has an inlet opening in register with said port and has a rearwardly opening recess concentrically surrounding said inlet opening. An annular liner of tough elastomeric material, received in said recess, has a conical rearwardly divergent rear surface slightly spaced from front edge portions of the impeller vanes. Wear of the liner is compensated for by inserting shims in front of it in the recess.

5 Claims, 6 Drawing Figures

TRASH PUMP WITH RESILIENT LINER

FIELD OF THE INVENTION

This invention relates to trash pumps, that is, to pumps for water that carries silt, sand and similar abrasive materials; and the invention is more particularly concerned with improvements in a mixed flow trash pump having an impeller that has forwardly projecting vanes whereby liquid is drawn rearwardly and is propelled radially outwardly with a substantial rearward component of flow.

BACKGROUND OF THE INVENTION

A trash pump is used for draining excavations and for similar pumping tasks in which it is required to pump water that may carry a significant load of solid particles such as sand. Because the solid particles would foul or ruin a positive displacement pump, a trash pump usually has a rotating impeller with vanes that are arranged to produce either an axial flow of the pumped liquid through the impeller, a radial flow, or a so-called mixed flow in which the impeller discharges the liquid generally radially but with a substantial component of rearward flow. An axial flow trash pump tends to operate at a relatively high output volume but with a relatively low pressure head, whereas a radial flow pump tends to discharge the pumped liquid under relatively high pressure but at a low rate. Thus, other things being equal, an axial flow trash pump is mainly suitable only for draining relatively shallow excavations, whereas a radial flow pump can drain a relatively deep excavation but does so rather slowly. A mixed flow pump offers a desirable combination of reasonably high volume and reasonably high pressure head, so that it is suitable for most applications, but heretofore mixed flow trash pumps have presented maintenance problems and have had other disadvantages which apparently discouraged their use to such an extent that axial flow and radial flow trash pumps have been commercially dominant.

In any trash pump, the vanes of the impeller move in an orbit that carries them very close to a fixed liner but not in contact with it. The smaller the distance between the vanes and the liner, the greater the efficiency of the pump, because the proximity of the vanes to the liner acts as a kind of seal between the high pressure and the low pressure sides of the impeller, preventing back flow to the extent that the seal is effective. On the other hand, the vanes cannot pass too close to the liner because solid particles carried by the pumped water have to be able to work through the space between the vanes and the liner in order not to jam the pump.

After a trash pump has been in use for some time, the abrasive action of water-carried particles tends to increase the distance between the vanes and the liner to the point where the efficiency of the pump is markedly impaired and repairs are needed. Since abrasive wear is practically inevitable in a trash pump, the facility with which repairs can be made is an important criterion of the merit of the pump.

In some prior trash pumps it was the front edges of the impeller vanes that passed close to the liner, and abrasive wear was compensated for by inserting shims behind the impeller to establish it at a more forward location on its shaft. Installation of the shims required disassembly of the pump to the point where the impeller was accessible so that it could be removed from its shaft. Opening up the housing of such a prior pump was seldom easy, but removal of the impeller was often a particularly difficult and annoying task because the impeller conventionally has a threaded securement to its shaft and the threads of the securement tend to become coated with sticky mineral and other deposits left behind by dirty water passing through the pump.

An old U.S. patent to Wilberforce, U.S. Pat. No. 640,345, issued in 1900, disclosed a radial flow trash pump having rigid liner elements that were spring urged into actual engagement with the front edges of the impeller vanes. The yielding mounting of the liner prevented solid particles from jamming the pump by facilitating their passage through it. Obviously, however, the arrangement produced relatively high frictional losses and must also have caused rather fast wear of the impeller and/or the liner.

U.S. Pat. No. 3,183,841, to Gaynor, disclosed a radial flow trash pump wherein the impeller had an annular lateral wall surface facing the inlet in the pump housing, and a resilient annular sealing member was secured in the housing in surrounding relation to the inlet and was maintained compressively engaged with the lateral wall surface on the impeller. To lubricate the zone of engagement between the resilient sealing member and the lateral wall surface on the impeller, clean water from an independent pressurized source was introduced through auxiliary water inlets in the housing. The utility of this pump was obviously limited to locations where pressurized clean water was available, which is to say that it could not be used in many situations where a trash pump was urgently needed.

More recently, U.S. Pat. No. 4,202,654, issued to A. S. Marlow in 1980, disclosed a radial flow trash pump having resilient annular liner elements adhesively secured to the front and back walls, respectively, of its volute, in coaxial relation to its impeller. The rear liner element lay closely behind a disc-like body or shroud plate of the impeller; the front one surrounded an inlet opening in the front wall of the volute and was close to the front edges of the impeller vanes, which projected forwardly from the shroud plate. To protect the impeller from erosion, it had an outer coating of elastomeric material. Although this coated impeller and its adjacent resilient liner elements were probably subject to less abrasion than more conventional all-metal parts, wear on those parts of a trash pump is practically inevitable, and replacement of those parts required a substantially complete disassembly of the pump for removal of the impeller from its threaded shaft. Since the pump comprised an extra-ordinarily large number of components, held together by bolts, its disassembly and reassembly tended to be complicated and time consuming in themselves.

As will be apparent from this rather sketchy summary of the state of the art, there has been a long-standing unfulfilled need for a trash pump that meets all of the following requirements:

- The pump should be low in first cost but efficient, and should be versatile in having the capability for sustained operation without need for a supply of clean water;
- Although there should be only a small space between the impeller blades and the liner, fairly large waterborne particles should nevertheless be able to pass through that space without jamming the pump;

The pump should sustain little abrasive wear on the opposing surfaces of its impeller vanes and liner during the course of a long period of operation;

By means of simple shims it should be possible to compensate for such wear as does occur on the impeller vanes and/or liner;

Shimming or replacement of the parts that are subject to abrasive wear should be possible with a minimum of disassembly and reassembly of the pump parts; and There should be no need to remove the impeller from its threaded shaft in order to compensate for abrasive wear, and the impeller should not normally require replacement during the life of the pump.

SUMMARY OF THE INVENTION

The general object of the present invention is to provide a mixed-flow trash pump that meets all of the requirements set forth above.

A more specific object of the invention is to provide a mixed flow trash pump wherein the front edges of the impeller vanes move closely adjacent to a liner made of a tough, resilient material that resists abrasion well but nevertheless, by reason of its resilience, allows relatively large solid particles to pass readily through the restricted space between the vanes and the liner.

It is also a specific object of this invention to provide a trash pump having a resilient liner that can be readily installed and removed by reason of its being received in a closely fitting recess in the volute and being held in place therein by the forces which the pump develops during its operation, without the need for bolts or other securement means.

A further specific object of the invention is to provide a trash pump having a liner that achieves the objective last described and wherein adjustment of the distance between said liner and the front edges of the impeller blades is readily accomplished by merely withdrawing the liner from its recess, inserting a shim behind it and replacing it into the recess.

It is an additional specific object of the invention to provide a trash pump wherein the resilient liner is received in a recess in a front wall of the volute as previously described, wherein the volute is secured to a hollow cover on the front of the pump housing, and wherein access to the resilient liner is obtained by merely releasing swing-away fasteners that hold the cover to the housing and then moving the cover away from the housing to withdraw the volute from the housing interior.

In general, the objects of the invention are attained in a trash pump having a mixed flow impeller that has forwardly projecting vanes and is rotatable on an axis to draw liquid rearwardly towards it and propel the liquid radially outwardly with a rearward component of flow, and a shaft by which the impeller is carried and which projects rearward from the impeller for connection with power drive means such as a gasoline engine. The trash pump is characterized by a housing that has an outlet opening in one side thereof, a large front opening substantially concentric with the shaft, and a rear wall through which the shaft extends and with which the shaft has a rotatable seal. In the housing, removable therefrom through said front opening, is a volute that defines a cavity wherein the impeller rotates and whereby liquid discharged from the impeller is guided for substantially spiral flow towards said outlet opening in the housing. The volute has a rear portion which is adjacent to the rear wall of the housing all around the shaft and wherein there is an opening through which the impeller can pass, and it also has a front wall wherein there is an inlet opening that is concentric to the impeller and a rearwardly opening recess of larger diameter than said inlet opening and concentrically surrounding the inlet opening. A cover member, to the rear of which the volute is secured, is detachably secured to the housing at the front thereof as a closure for said large front opening, and a port in the cover member is in register with the inlet opening in the volute. In said recess in the volute there is an annular liner of resilient material such as polyurethane, having a substantially rearwardly facing surface closely adjacent to the orbit of front edge portions of the impeller vanes.

BRIEF DESCRIPTION OF DRAWINGS

In the accompanying drawings, which illustrate what is now regarded as the preferred embodiment of the invention.

DETAILED DESCRIPTION OF PREFERRED EMBODIMENT OF THE INVENTION

Figure 1:
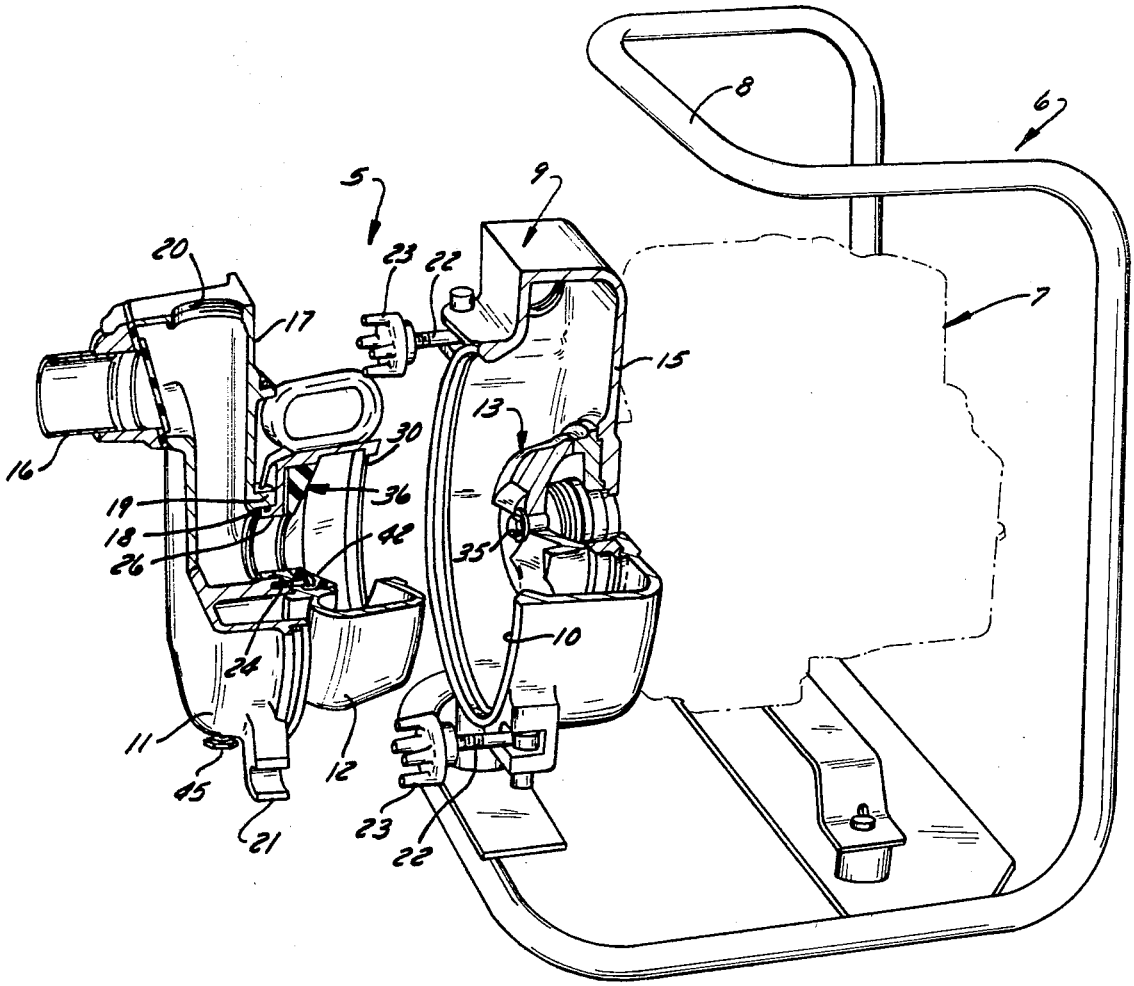
FIG. 1 is a disassembled side perspective view of a trash pump embodying the principles of this invention, with portions cut away to show details of the interior parts of the pump.

In the form in which the trash pump 5 of this invention is illustrated in the accompanying drawings, it is mounted on a frame 6 of metal tubing which also supports a single-cylinder gasoline engine 7 that is behind the pump and drivingly connected to it. The frame 6, in addition to providing a common mounting for the pump 5 and its drive means 7, serves as a protective guard for the machine and comprises a handle 8 whereby it can be carried.

The pump 5 comprises a housing 9 in which there is a large front opening 10 that is normally closed by a hollow cover 11, a volute 12 which is attached to the rear of the cover 11 and is normally inside the housing, and an impeller 13 that rotates within the volute 12. The impeller 13 is secured to an impeller shaft 14 that extends through a rear wall 15 of the housing and has a rotatable seal therewith. At its rear end the shaft 14 is coaxially coupled to the crankshaft of the engine 7, and the rear wall 15 of the housing is suitably fastened to the engine crankcase.

Figure 2:
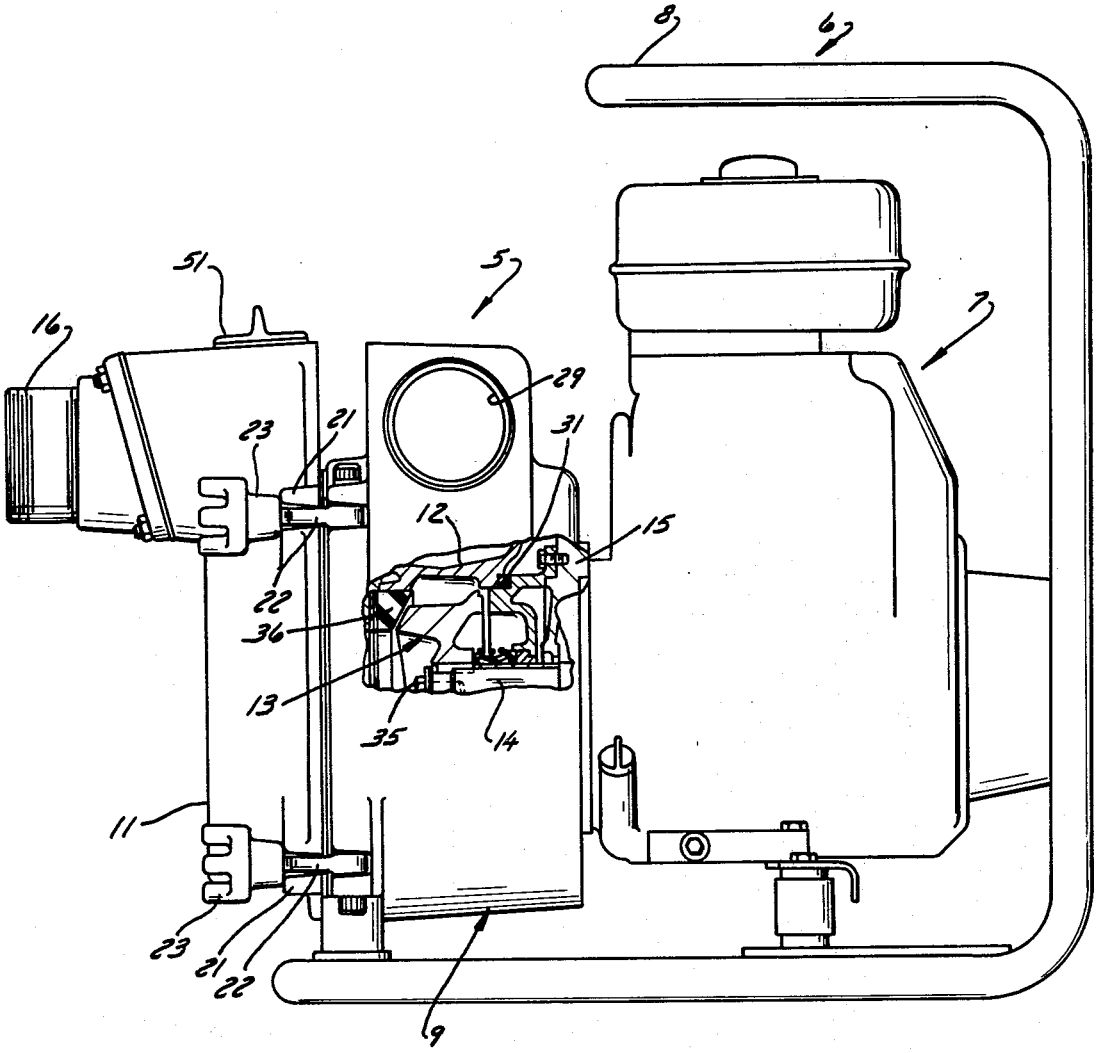
FIG. 2 is a view of the pump in side elevation, with portions cut away.
Figure 3:
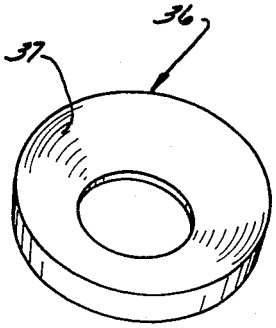
FIG. 3 is a perspective view of the liner of the pump of this invention.

The cover 11 is hollow to serve as an inlet passage that conducts pumped water to the volute 12 and also to function as a receptacle or standpipe whereby the interior of the housing 9 tends to be kept filled with water when the impeller 13 is not rotating, so that the pump does not have to be primed after every shut-down. Pumped water enters the hollow cover 11 through an inlet nipple 16 at its top, comprising a standard fitting connectable with a suction duct or hose (not shown) through which water is drawn towards the pump. In the rear wall 17 of the cover there is a port 18, concentric with the impeller shaft 14 and surrounded by a rearwardly projecting flange 19, through which water enters the volute 12. In a top wall of the cover there is a priming port 20 (FIG. 1), normally closed by a removable cap 51 (FIG. 2), through which priming water can be poured into the pump. Preferably there is a removable drain plug 45 in a bottom portion of the hollow cover.

The cover 11 has four lugs 21, two at each side of it, each of which defines a laterally outwardly opening groove for receiving a swing-away connector bolt 22 hingedly secured to the housing 9. A nut 23 on the threaded front end portion of each swing-away bolt 22 overlies the front of the adjacent lug 21 on the cover to secure the cover to the front of the housing, where the cover closes the large opening 10 in the housing except insofar as the port 18 in the cover provides an inlet to the interior of the housing. The cover 11 and the housing 9 have interengaging circumferential ridges or the like that cooperate with a suitable gasket to provide a seal between the cover and the housing.

Figure 6:
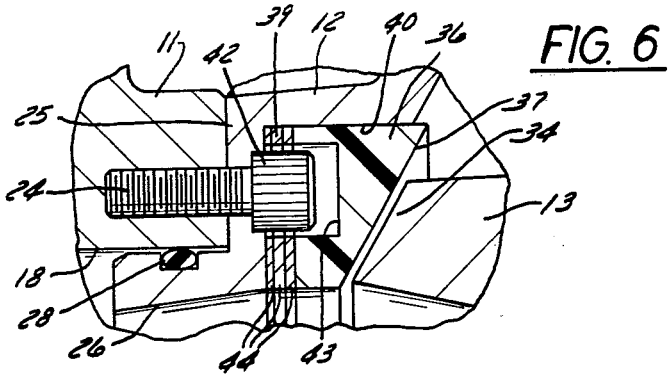
FIG. 6 is a detail sectional view taken on the plane of the line 6—6 in FIG. 5.

The volute 12 is secured to the rear of the cover 11 by means of bolts 24 that have their heads 42 in the volute and project forwardly through its front wall 25 to be threaded into the cover (see FIG. 6). The front opening 10 in the housing is large enough for the volute to pass through it during installation of the cover 11 onto the housing or its removal therefrom, and there is an opening 30 in the rear of the volute through which the impeller 13 can pass; hence the volute and the impeller 13 become accessible by mere release of the swing-away bolts 22 and forward movement of the cover to withdraw the attached volute from the housing.

In the front wall 25 of the volute 12 there is an inlet opening 26 that is concentric with the impeller shaft 14 and in register with the port 18 in the rear wall of the cover. A forwardly projecting annular flange 27 on the front wall of the volute, surrounding the inlet opening 26, is received within the rearwardly projecting flange 19 on the cover. An O-ring 28 confined between the two flanges 19 and 27 provides a seal between the cover and the volute.

Pumped water flows rearwardly towards the impeller 13 through the inlet opening 26 in the volute; and the impeller 13, by its rotation, propels the water generally radially outwardly but with a rearward component of flow. The volute 12 defines, as is conventional, a spiral cavity around the impeller whereby the water issuing from the impeller is guided towards an outlet 29 at one side of the housing. The outlet 29 is at a level substantially above the impeller 13, as is the inlet nipple 16 on the cover, so that water tends to remain in the housing when the pump is stopped, to avoid the need for priming after every shut-down.

A rear portion of the volute 12, surrounding the opening 30 therein, is adjacent to the rear wall 15 of the housing and cooperates therewith, as at 31, to provide a seal around the bearing for the impeller shaft 14.

Figure 4:
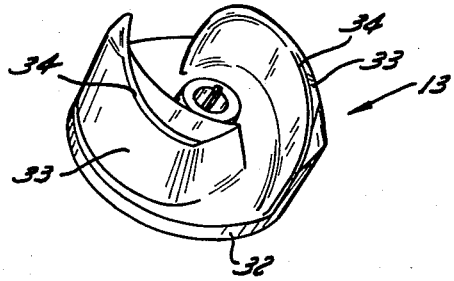
FIG. 4 is a perspective view of the impeller of the pump.

The impeller 13 (FIG. 4) has a rear body portion 32 with a frustoconical, forwardly tapering front surface 33 from which a pair of spiral vanes 34 project forwardly. As is generally conventional, the impeller 13 is keyed to its shaft 14 and secured by means of a bolt 35 that is coaxially threaded rearwardly into that shaft.

The front edges of the radially outermost portions of the impeller vanes 34 are inclined radially outwardly and rearwardly and are closely adjacent and parallel to the conical rear surface 37 of a resilient annular liner 36 that is confined in a rearwardly opening recess in the front wall 25 of the volute. The central hole in the annular liner 36 is in register with the inlet opening 26 in the volute, so that in effect the liner 36 cooperates with the front flange 27 on the volute to define a short concentric inlet passage whereby water is conducted towards the impeller 13 from the interior of the hollow cover 11. At its rear end this passage is swept by the radially innermost portions of the impeller vanes 34, and the front edges of these portions of the vanes lie in a plane normal to the impeller axis.

Figure 5:
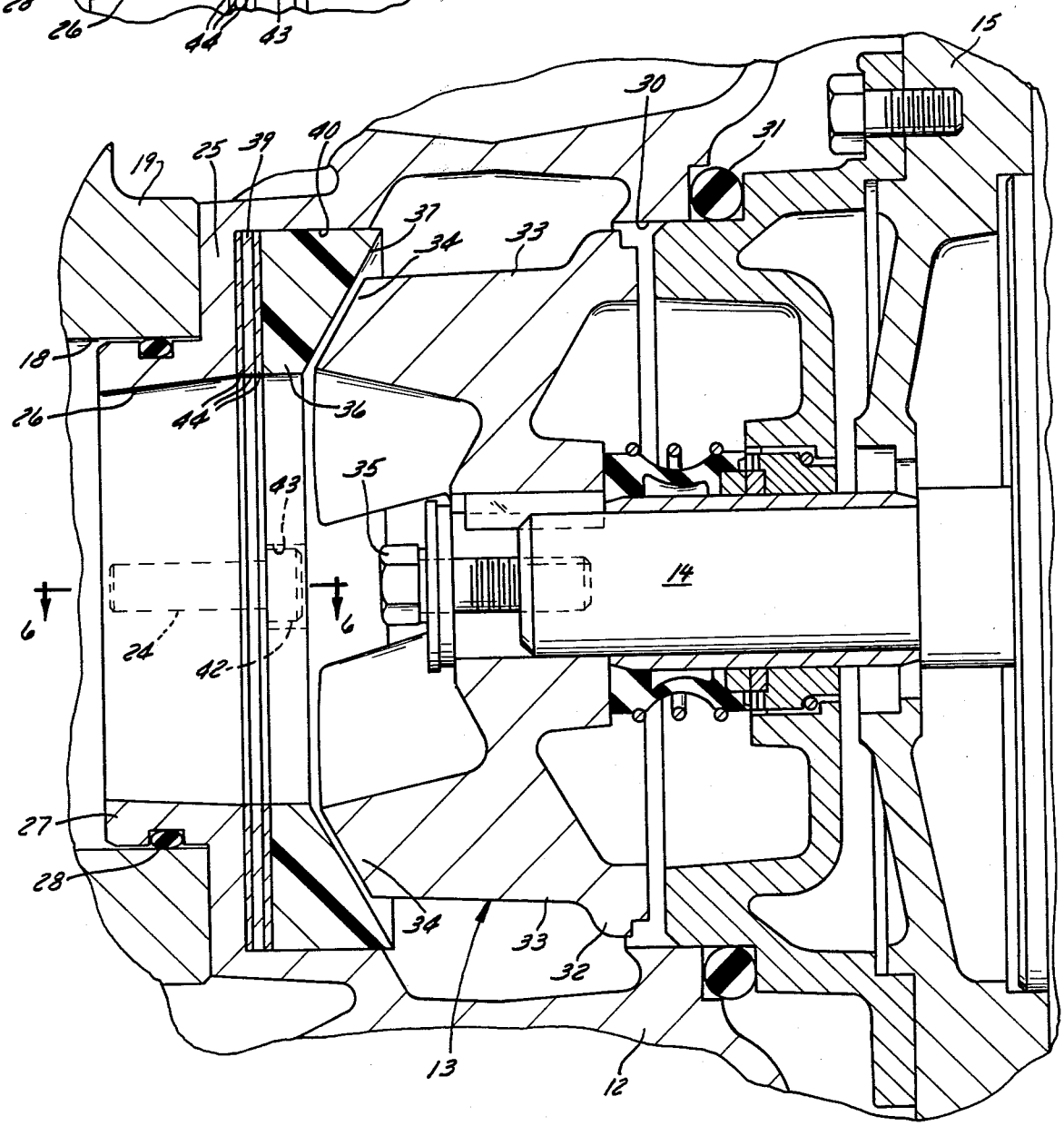
FIG. 5 is a longitudinal sectional view on a larger scale, taken substantially on a vertical plane containing the axis of the pump.

As best seen in FIG. 5, the frustoconical rear surface 37 of the resilient liner 36 diverges rearwardly at about the same angle as the front surface 33 of the impeller body 32, so that these surfaces, together with adjacent internal surfaces of the volute, impart a rearward component of flow to water propelled radially outwardly by the spiral impeller vanes.

The annular recess in the front wall 25 of the volute wherein the resilient liner 36 is received is, in effect, a rearwardly opening counterbore in that wall that defines a flat and annular rearwardly facing surface 39 around the inlet opening 26 and a cylindrical internal wall surface 40 which extends rearwardly from that flat surface 39. The liner 36 fits in that recess closely but not necessarily tightly, being confined against displacement out of the recess by pressure imposed upon its conical rear surface 37 due to the action of the impeller 13 upon water being pumped. The bolts 24 by which the volute is attached to the cover have substantially large socket heads 42 that project rearwardly beyond the flat rear surface 39 of the recess to be received in forwardly opening cavities 43 in the liner, and the bolt heads 42 thus confine the liner against rotation in the recess.

The liner 36 is molded of an elastomer such as polyurethane or pentathane. By reason of its rsilience, the liner can yield to permit passage of relatively large solid particles through the small space between its rear surface 37 and the adjacent front edge portions of the impeller vanes 34, and because of its toughness as well as its resilience it resists abrasion by such particles. However, the liner does wear away in the course of time, and in fact the present invention contemplates sacrifice of the liner in favor of sparing the impeller, because compensation is readily made for a small amount of wear on the liner and replacement of the liner when it becomes excessively worn can be accomplished quickly, easily and at relatively small cost.

It will be apparent that as the liner 36 becomes abraded, compensation can be made for wearing away of its conical rear surface 37 by the insertion of annular shims 44 between its flat front face and the flat annular recess surface 39 in the volute. If the liner becomes worn to the point where its conical rear surface 37 is no longer true or concentric, it can be replaced at low cost inasmuch as it is a simple molded part.

It will be apparent that when the liner 36 needs shimming or replacement, it is merely necessary to loosen the nuts 23 on the swing-away bolts 22, swing those bolts clear of their lugs 21, and draw the cover 11 forward to bring the volute 12 out of the housing 9. The liner 36 is then readily accessible through the opening 30 in the rear of the volute and can be slid out of its recess in the front wall of the volute. The whole procedure, including reassembly in an obvious manner, can be accomplished very quickly and without the need for special tools or any high degree of skill.

From the foregoing description taken with the accompanying drawings it will be apparent that this invention provides a simple and very efficient trash pump that can operate for long periods of time without requiring attention and can be easily and inexpensively restored to prime condition when its efficiency has been reduced by inevitable abrasive wear.

What is claimed as the invention is:

1. A trash pump having an impeller that has forwardly projecting vanes and is rotatable on an axis to draw liquid rearwardly towards it and propel the liquid radially outwardly, and a shaft by which the impeller is carried and which projects rearward from the impeller for connection with power drive means, said trash pump being characterized by:

A. a housing around the impeller having
  (1) an outlet opening in one side thereof,
  (2) a large front opening substantially concentric with the shaft, and
  (3) a rear wall through which the shaft extends;

B. a volute in the housing wherein the impeller rotates and whereby liquid discharged from the impeller is guided for substantially spiral flow towards said outlet opening in the housing, said volute being removable from the housing through said front opening and having
  (1) a rear portion which is adjacent to said rear wall of the housing around the shaft and wherein there is an opening through which the impeller can pass, and
  (2) a front wall wherein there is
    (a) an inlet opening concentric to the impeller and
    (b) a rearwardly opening recess of larger diameter than said inlet opening and concentrically surrounding the same;

C. a cover member detachably secured to the housing at the front thereof as a closure for said front opening and wherein there is a port that is concentric to the impeller;

D. means securing the volute to the rear of the cover member to be removable from the housing with removal of the cover member therefrom, with said inlet opening in the front wall of the volute in register with said port in the cover member; and E. an annular liner of resilient material in said recess in the volute, having a substantially rearwardly facing surface closely adjacent to the orbit of front edge portions of the vanes of the impeller.

2. The trash pump of claim 1, further characterized by:
  (1) the volute having on its front wall a forwardly projecting annular flange around said inlet opening,
  (2) the cover member having a rearwardly projecting annular flange surrounding said port, and
  (3) one of said annular flanges being in surrounding and sealed relation to the other one.

3. The trash pump of claim 1 wherein said outlet opening in the housing is at a level above the impeller, further characterized by:
  said cover member being hollow and
    (1) having said port in a rear wall thereof, and
    (2) having other walls which define an inlet chamber that leads downwardly to said port from an intake opening in the cover member that is at a level above the impeller.

4. The trash pump of claim 1, further characterized by:
  (1) said means securing the volute to the cover member comprising bolts that project forwardly through the front wall of the volute and are threaded into the cover member;
  (2) said bolts having heads that project rearward in said recess; and
  (3) said liner having forwardly opening cavities in which the heads of the bolts are received to prevent rotation of the liner in the recess.

5. The trash pump of claim 1 wherein said impeller is a mixed flow impeller having a body with a conical, forwardly convergent front surface from which said vanes project forwardly and wherein said front edge portions of the vanes are inclined rearwardly and radially outwardly, further characterized by:
  said rearwardly facing surface of the liner being conical and rearwardly divergent.

* * * * *